United States Patent [19]

Lethen et al.

[11] 3,998,365

[45] Dec. 21, 1976

[54] METHOD AND ARRANGEMENT FOR DISPENSING QUANTITIES OF MOLTEN METAL BY PNEUMATIC PRESSURE

[75] Inventors: Robert Lethen; Fritz Ostler, both of Simmerath, Lammersdorf; Heinz Heimerich, Roetgen; Manfred Kienert, Simmerath, Lammersdorf, all of Germany

[73] Assignee: Otto Junker GmbH, Simmerath, Germany

[22] Filed: May 7, 1975

[21] Appl. No.: 575,405

[30] Foreign Application Priority Data

July 10, 1974 Germany ..... 2433060

[52] U.S. Cl. ..... 222/590; 164/306; 222/70; 222/397; 222/595

[51] Int. Cl.[2] ..... B22D 39/00

[58] Field of Search ..... 222/1, 61, 70, 76, 394, 222/396, 397, 590, 595; 266/38; 164/154–156, 306

[56] References Cited

UNITED STATES PATENTS

| | | | |
|---|---|---|---|
| 2,937,789 | 5/1960 | Tama | 222/1 |
| 3,058,180 | 10/1962 | Port, Jr. et al. | 164/156 |
| 3,412,899 | 11/1968 | Sutter | 222/394 UX |
| 3,465,916 | 9/1969 | Hibband et al. | 222/70 |

*Primary Examiner*—Robert B. Reeves
*Assistant Examiner*—David A. Scherbel
*Attorney, Agent, or Firm*—Michael J. Striker

[57] ABSTRACT

Molten metal is poured, in at least two successive operations, from a container having an interior closed off substantially gas-tightly and provided with a pour-out conduit which has an inlet communicating with the interior of the container and which has an outlet pouring opening located outside the container above the highest level to which molten metal in the container interior is permitted to rise. The metal in the conduit is established at a predetermined starting level prior to the start of the first pouring operation by feeding pressurized gas into the space above the molten metal in the container interior. Thereafter, each pouring operation is effected by boosting the gas pressure in such space by an amount requisite to effect pouring out through the pouring opening of the quantity of molten metal to be dispensed. At the end of each pouring operation, the gas pressure in such space is decreased to a value causing the metal in the pour-out conduit to sink down to the starting level, and the pressure is maintained at that value to maintain the metal at the starting level until the start of the next-following pouring operation.

28 Claims, 5 Drawing Figures

METHOD AND ARRANGEMENT FOR DISPENSING QUANTITIES OF MOLTEN METAL BY PNEUMATIC PRESSURE

BACKGROUND OF THE INVENTION

The invention relates, generally, to a method of pouring predetermined quantitites of molten metal from a container through an inclined pour-out conduit having an inlet in the region of the bottom of the container and having an outlet at a level higher than the highest level to which molten metal is permitted to rise within the container, involving the controlled supply of pressurized gas into the interior of the container, the container being substantially gas-tightly sealed by means of a covering dome. More particularly, the invention relates to the pouring of predetermined quantities of molten metal in at least two successive pouring operations, with the molten metal level in the pour-out conduit being set to the same "starting level" at the start of each pouring operation by effecting a "starting pressure" build-up in the interior of the container, the starting level being beneath the level of the pouring opening but higher than the highest level to which molten metal is permitted to rise within the body of the container, with each pouring operation being initiated by superimposing upon the aforementioned starting pressure an additional "pouring pressure" which together add to form the total "feed pressure".

The invention also relates to an arrangement for performing the method.

When pouring molten metal from a container, for example from a foundry ladle or from a holding furnace, using pressurized gas, preferably pressurized air, to force the molten metal to leave the container, it is in general necessary that each pouring operation involve the pouring or dispensing of an exactly predetermined quantity of molten metal. In this connection, a particular problem resides in the fact that the upper surface of the molten metal descends inside the container during each pouring operation, resulting in a continuing increase in the static pressure difference inside the pour-out conduit between the level of the pouring opening and the level of the upper surface of the molten metal bath inside the container. If during a particular series of pouring operations the same quantity of molten metal is to be poured out during each successive pouring operation, then it is not enough to employ during each successive pouring operation the same feed pressure $p_f$ and the same so-called "pouring time" $t_g$, i.e., the time during which the feed pressure $p_f$ is maintained during the pouring. Instead, if the values of $p_f$ and $t_g$ are kept constant during the series of pouring operations, the quantity of molten metal dispensed will decrease from one pouring operation to the next.

Experience has indicated that, to maintain constant the quantity of molten metal dispensed in successive pouring operations, the metal bath in the pour-out conduit must, prior to each pouring operation, be forced to rise up to a level below that of the pouring opening of the pour-out conduit but above the highest level to which the metal bath is permitted to rise in the interior of the container, i.e., must be forced up to the so-called starting level, by introducing pressurized gas into the interior of the container, i.e., into the space above the upper surface of the molten metal bath occupying the interior of the container. The gas pressure needed to establish this starting level is referred to herein as the starting pressure $p_v$. The starting pressure $p_v$ increases during a series of pouring operations, from one pouring operation to the next, with the decrease, from one pouring operation to the next, of the quantity of metal in the container. After the establishment of the starting level, the dispensing of molten metal from the pouring opening of the pour-out conduit is effected by increasing the gas pressure in the interior of the container, as a result of which the metal bath level in the pour-out conduit rises up to the pouring level. To this end, the gas pressure in the interior of the container is increased from the starting pressure $p_v$ by addition of the so-called pouring pressure $p_g$, to produce the feed pressure $p_f$. Accordingly, at the start of each pouring operation $p_f = p_v + p_g$.

With the known method the interior of the container, i.e., the space above the molten metal bath therein, is usually completely depressurized, so that atmospheric pressure prevails in the interior of the container. With this approach, prior to each pouring operation, the gas pressure must be raised from atmospheric pressure by the amount of the predetermined starting pressure. Between the individual pouring operations there are present undesirable dead times, not only in consequence of the complete collapse of the overpressure in the interior of the container, but also because the level of the upper surface of the metal bath in the pour-out conduit, on account of the large height difference corresponding to the large difference between atmospheric pressure and starting pressure, oscillates about the two corresponding levels, alternately rising above and falling below each of these two levels before finally assuming a steady level. Considerable time must pass before the liquid level in the pour-out conduit ceases to alternately rise and fall and finally assumes a steady level. If the liquid level is not given time enough to assume a steady level and if instead the next pouring operation is initiated before such steady level is assumed, the pouring operation will be very imprecise.

The known method of pouring predetermined amounts of molten metal by using pressurized gas in general does not take into account the collapse of the overpressure in the interior of the container attributable to gas leakages. As a result, it becomes impossible to precisely dispense predetermined quantities of molten metal, particularly when different quantities of metal are to be dispensed or when the dead times between the individual pouring operations are not of equal duration.

If using the known method the quantity of molten metal to be disposed is to be the same from one pouring operation to the next, then it is not possible to replenish the container with additional molten metal during the actual performance of a pouring operation. Instead, the container must be replenished during the pauses between successive pouring operations, which likewise leads to undesired dead times between the individual pouring operations.

SUMMARY OF THE INVENTION

It is accordingly a general object of the invention to provide a method and an apparatus which, in a reliable way, without complicated measuring and control devices, and at low cost, make it possible, starting from a certain starting level of the metal bath in the pour-out conduit, to initiate without time delays the dispensing of precisely predetermined quantities of molten metal.

This object can be achieved, according to one advantageous concept of the inventive method, by causing the increase of the static pressure of the melt in the pour-out conduit between the pouring opening and the level of the metal bath in consequence of the pouring to be balanced out by an increase in the starting pressure corresponding to the dispensed quantity of metal, and by depressurizing the interior of the container at the end of each pouring operation for so long until the level of the metal bath in the pour-out conduit has sunk down to the starting level, with the starting pressure prevailing after the depressurization being maintained until the start of the next-following pouring operation.

This method makes possible very short pouring cycles, but with the predetermined quantity of metal nevertheless being maintained very exactly. Since at the end of each pouring operation the starting level is immediately established and thereafter maintained, each time a new pouring operation can be initiated without delay. Since at the end of a pouring operation the metal bath level in the pour-out conduit sinks from the pouring level down only to the starting level, disturbing hunting or oscillating of the metal level in the pour-out conduit, prior to assumption of a steady level in the pour-out conduit, does not occur. The inventive method accordingly makes it possible to exactly maintain the predetermined metal quantity to be poured during each individual pouring operation.

Since the starting pressure increases in correspondence to the decrease of the quantity of metal present in the interior of the container, the container can be replenished with additional metal during a series of pouring operations and even during a single pouring operation. In the event of a premature termination of a pouring operation, as a result of some malfunction, the predetermined quantity of metal will not be dispensed. Nevertheless, with the aforedescribed manner of increasing the starting pressure, a new pouring operation can be initiated immediately; there is required prior to the start of the next-following pouring operation no special or time-consuming determination of the increase of the starting pressure necessary to push the bath level in the pour-out conduit up to the predetermined starting level.

The dead times between the individual pouring operations are then particularly short and the predetermined quantities to be poured can be exactly adhered to if the increase of the starting pressure is performed during each pouring operation. The increase of the starting pressure, particularly in dependence upon the length of the pouring time, can be performed either during the course of the total pouring time or else during the course of a part of the pouring time; for the so-called starting pressure build-up time $t_v$, the equations of interest would accordingly be either $t_v = t_g$ or $t_v < t_g$.

The increase of the starting pressure and/or the depressurizing of the container at the end of each pouring operation and/or the maintaining constant of the starting pressure between the depressurizing and the start of the next-following pouring operation is advantageously effected automatically. In this way, the pouring work is largely independent of the human operator's skill and ability to concentrate, resulting in optimum dispensing of molten metal.

According to a further preferred concept of the invention, it is advantageous to effect the increase of the starting pressure, and/or the maintenance of the starting pressure between the depressurizing and the start of the nextfollowing pouring operation, by means of additional feeding of pressurized gas into the interior of the container. It is furthermore advantageous to effect the additional supply of pressurized gas in either a stepwise or continuous manner. It is advantageous to effect the additional supply of pressurized gas by making stepwise or continuous changes in the setting of a gas supply valve.

It is preferred to effect the additional supply of pressurized gas by means of a starting pressure timer.

According to another concept of the invention, the additional feeding of pressurized gas is effected under the control of a weigher operative for determining the weight of the quantity of metal present in the interior of the container.

It is advantageous to apply to the gas supply valve an electrical signal correspondng to the weight detected by the weigher.

Additionally, it is particularly advantageous to convert into two proportional electrical voltages the desired value for the starting pressure called for by the weight detected by the weigher, on the one hand, and, on the other hand, the actual value of the starting pressure, and to then compare these two electrical voltages against each other, and to apply to the gas supply valve an electrical signal corresponding to the discrepancy between these two electrical voltages. In this way, the starting pressure can be changed in correspondence to changes in the weight of the quantity of metal in the interior of the container, in a very simple manner, through the use of a weigher. It is merely necessary to calculate the actual value of the starting pressure, i.e., the value of the starting pressure prevailing at any moment in the interior of the container, as well as the weight of the quantity of metal occupying the interior of the container at the same moment, since such weight always corresponds to the desired value for the starting pressure, i.e., corresponds to that value of the starting pressure which is capable of raising the bath level in the pour-out conduit of the container at the moment in question to the predetermined starting level.

According to the invention, at the end of each pouring operation, the interior of the container is vented or depressurized by briefly opening a venting or depressurizing valve. It is advantageous to have the venting valve open in response to a signal generated by a pouring time timer after elapse of the respective pouring time.

In an advantageous embodiment of the invention, the venting valve is closed after the elapse of the so-called venting time interval $t_e$, which is set on a venting time timer and which corresponds to the quantity of metal dispensed during the preceding pouring operation. According to another embodiment, the venting valve is closed after a time interval corresponding to the weight of the quantity of metal located in the interior of the container and detected by the weigher.

The inventive arrangement, according to one advantageous concept of the invention, comprises an arrangement which controls the feeding of pressurized gas into the interior of the container which holds the molten metal. The gas feed control arrangement is provided with an adjustable starting pressure timer electropneumatically connected with a gas supply valve, and is further provided with an adjustable venting timer electropneumatically connected with a venting valve and electrically connected to a pouring time timer.

According to another advantageous concept of the invention, the inventive gas feed control arrangement is comprised of a control stage electrically connected to a weigher operative for detecting the weight of the quantity of metal located in the interior of the container and to a pouring time timer, and is electropneumatically connected to a gas supply valve and to a venting valve. According to the invention, it is advantageous to electropneumatically connect the control stage, via a venting timer, with the venting valve.

It is advantageous to associate with the weigher a measuring transducer operative for generating an electrical signal proportional to the measured weight and for applying such signal to the control stage.

According to another advantageous concept of the invention, the control stage includes a regulator electrically connected to the measuring transducer associated with the weigher, to a switch and to a potentiometer, with an electrical voltage corresponding to the actual valve of the starting pressure being applied to the regulator. In such case, the potentiometer wiper is advantageously at least indirectly coupled to the output shaft of an adjusting motor; the position of the wiper of the potentiometer, which determines the electrical voltage applied by the potentiometer to the regulator, upon rotation of the output shaft of the adjusting motor, changes in correspondence to the rotation time interval of this output shaft.

The inventive arrangements distinguish themselves by a lack of complicated, malfunction-prone and expensive measuring and control units, and by reliable operation. In particular there are no measuring or control devices in contact with the metal bath such as would require frequent repair and/or maintenance, for example due to oxidation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
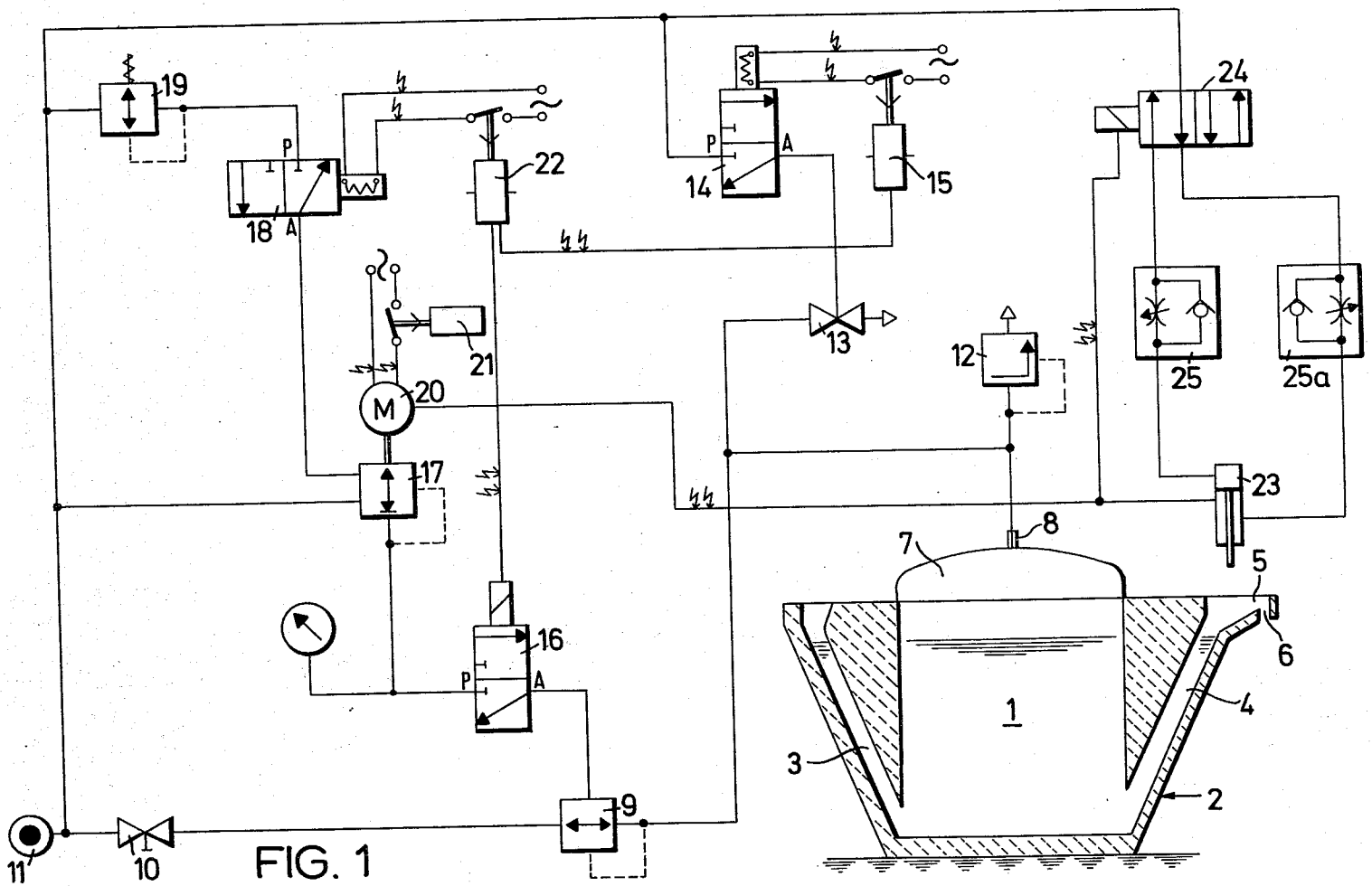
FIG. 1 schematically depicts a pouring arrangement provided with a starting pressure timer.

In FIG. 1, reference numeral 2 designates a container partially filled with molten metal 1. The container 1 has a pour-in conduit 3 and a pour-out conduit 4. The pour-out conduit 4 starts at the bottom region of the container 2, whereas the end section containing the pouring opening 5 extends out of the container 2 to such an extent that the pouring opening 5 is located above the maximum filling level of the container 2. The pouring opening 5 is of funnel-like configuration and provided with a downwardly directed nozzle 6. The interior of the container 2 is closed off substantially gas-tightly by a cover dome 7. The cover dome 7 contains the inlet nipple 8 for the pressure gas, the nipple 8 being connected via the gas supply valve 9 and the hand-operated shutoff valve 10 to the pressure gas source 11. The gas supply valve 9, constituting a so-called "flow amplifier", is an infinite-position reversible-flow pneumatically controlled regulating valve; it regulates the flow rate of pressure gas flowing into the interior of container 2 from the source 11. It is a flow amplifier in the sense that a smaller-magnitude pneumatic control signal controls a considerably more powerful gas flow.

Communicating with the conduit which connects the flow amplifier 9 to the gas inlet nipple 8 are in an infinite-position safety valve 12 and a venting valve 13, by means of which the pressure gas which has streamed into the interior of the container can be exhausted into the open air with a predetermined constant volumetric flow rate so that the overpressure previously established in the interior of the container can be caused to at least partially collapse. The venting valve 13 is controlled by means of an electromagnetically actuated three-port two-position valve 14. The electromagnetic actuation of the magnet valve 14 is performed by means of a venting timer 15 on which the venting time $t_e$ is set.

The flow amplifier 9, through the intermediate connection of an electromagnetically actuated three-port two-position magnet valve 16, is pneumatically controlled by the signal pressure at the output of a flow amplifier relay 17. The flow amplifier relay 17 is an infinite-position reversible-flow regulating valve. It has one inlet which receives pressure gas from the source 11, and another inlet which receives a signal pressure from a pouring pressure regulator 19, through the intermediary of an electromagnetically actuated three-port two-position magnet valve 18 when the latter is in the flow-through position (the non-illustrated position).

The flow amplifier relay 17 is operative for providing an output pressure which corresponds to the difference between a mechanically set spring load and a variable pneumatic control input signal. For example, the relay 17 can provide an output that decreases in direct proportion to the increase in signal pressure. In FIG. 1 it will be understood that the lower left inlet of relay 17 is the operating pressure inlet, that the upper left inlet is the control or signal pressure inlet, and that the lower outlet is the pressure outlet of the relay. The broken feedback line schematically indicates that the flow amplifier relay 17 is provided with internal stabilizing means which improve performance, but do not require detailed discussion here. The flow amplifier relay 17 additionally has a mechanical input, shown connected to the output shaft of an adjusting motor 20. This mechanical input may for example be an adjusting screw which is turned by the output shaft of adjusting motor 20 to vary the spring pretension of the flow amplifier relay 17.

In any event, the flow amplifier relay 17 is controlled by the electrically driven adjusting motor 20, which in turn is connected to a starting pressure timer 21. If the adjusting motor 20 is energized via the starting pressure timer 21 so that the motor output shaft changes position, this causes a change in the setting of the flow amplifier relay 17, resulting in a change of the signal pressure at the output of the flow amplifier relay 17.

When the magnet valve 18 is in the blocking position, the shut-off valve 10 open and the venting valve 13 closed, the setting of the flow amplifier relay 17, via the magnet valve 16 and the flow amplifier 9, produces a certain starting pressure $p_v$ in the interior of the container 2. Accordingly, when the valve 18 is in the illustrated blocking position, the signal pressure at the outlet flow amplifer relay 17 is the starting pressure pressure signal. If the starting pressure pressure signal at the outlet of the flow amplifier relay 17 is caused to increase with time, as a result of a change of the setting of adjusting motor 20 under the control of the starting pressure timer 21, then in correspondence thereto the starting pressure $p_v$ in the interior of the container 2 will increase with time. The rate of change of the starting pressure $p_v$ is $\Delta p_v/\Delta t$. Upon elapse of the starting pressure build-up time $t_v$, the starting pressure $p_v$ has accordingly become increased by the amount $t_v \cdot (\Delta p_v/\Delta t)$.

The pouring pressure regulator 19 is an infinite position regulator operable by hand against the restoring force of a return spring. The pouring pressure $p_g$, which during the time of the pouring is to be superimposed upon the starting pressure $p_v$, is set on the pouring pressure regulator 19. When the magnet valve 18 is in the conductive position, the pouring pressure signal pressure at the outlet of the pouring pressure regulator 19 is added to the starting pressure pressure signal which is already present at the outlet of the flow amplifier relay 17 when the magnet valve 18 is in the blocking position.

The magnet valve 18 is activated by means of a pouring time timer 22, with the time interval during which the magnet valve 18 is in the conductive position constituting the pouring time $t_g$.

In this embodiment, the upper surface of the molten metal in the pour-out conduit 4 is caused to assume the predetermined starting level at the start of a series of successive pouring operations by means of a detector electrode 23 associated with the pour-out conduit 4. The detector electrode 23 constitutes the end section of the vertically movable piston rod of an electrically conductive double-acting cylinder-and-piston unit. The detector electrode 23 can be caused to descend into the pouring opening 5 until it reaches the predetermined starting level and then, after the upper surface of the molten metal in the pour-out conduit 4 assumes the predetermined starting level, the detector electrode 23 can be retracted to its illustrated position. The movement of the piston and piston rod to which the detector electrode 23 is attached is controlled by means of an electromagnetically actuated three-port two-position valve 24, one inlet port of which is connected to the outlet of the source 11, and by means of two restrictor valve units 25, 25*a*. Each of the units 25, 25*a* permits the free flow of gas in one direction and the restricted flow of gas in the other direction, the restricted flow being the result of the provision of adjustable flow restrictors.

The trigger contact of the detector electrode 23 is electrically connected to the adjusting motor 20 of the flow amplifier relay 17 as well as to the electromagnet of the magnet valve 24, so that the adjusting motor 20 and the magnet valve 24 receive from the detector electrode 23 a signal when the detector electrode 23 detects the metal lever. Additionally, the pouring time timer 22 is electrically connected to the venting timer 15 as well as to the magnet valve 16, so that the pouring timer 22 applies a pulse to the venting timer 15 after the elapse of each pouring time and applies a pulse to the magnet valve 16 at the start of the venting, with the venting timer 15 applying a pulse to the magnet valve 16 at the end of the venting.

Figure 2:
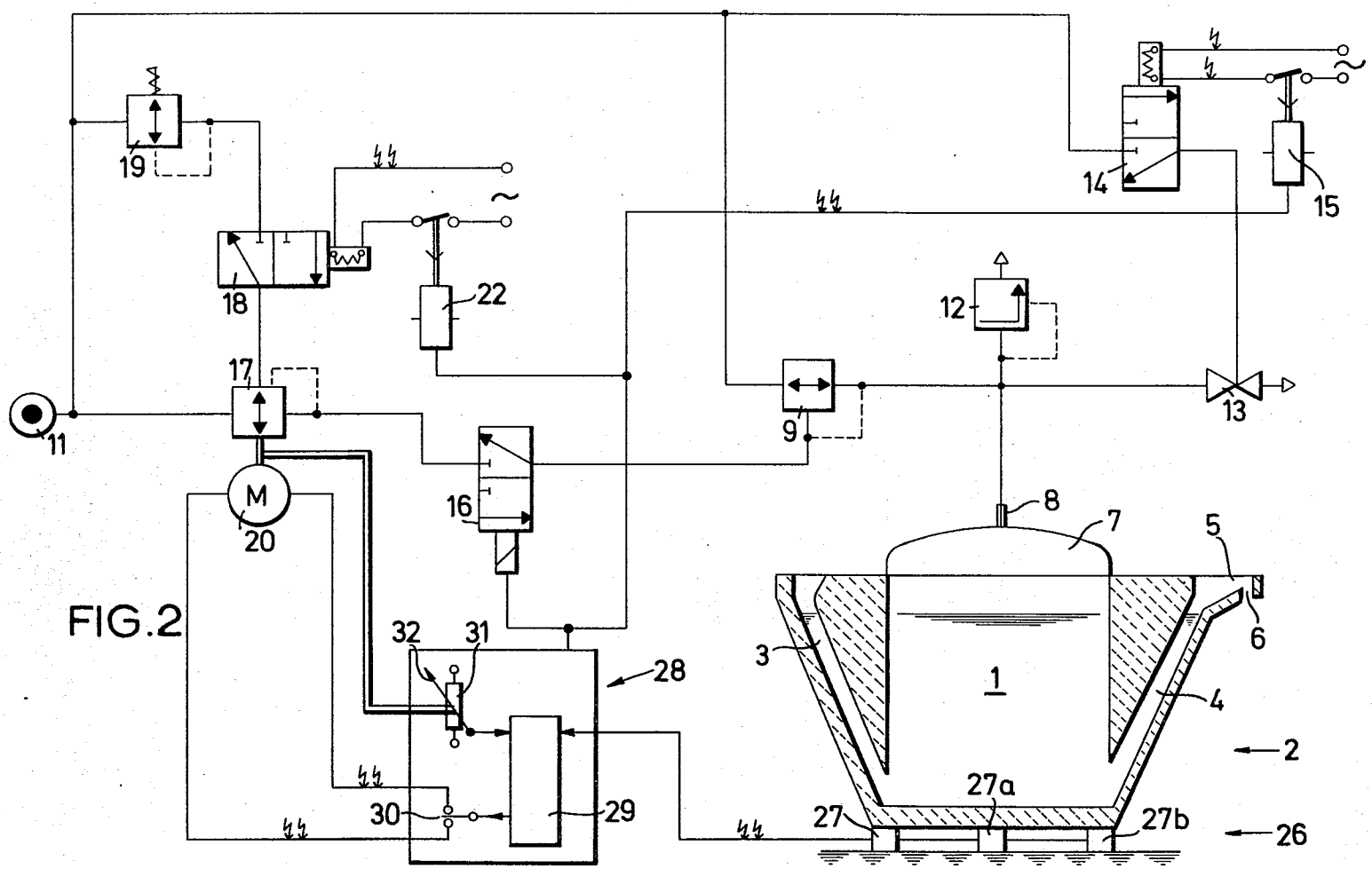
FIG. 2 schematically depicts a pouring arrangement provided with a metal weigher.

The pouring engagement depicted in FIG. 2 differs from that of FIG. 1 principally in that the detector electrode 23, the associated two restrictor valve units 25, 25*a* and the valve 24, on the one hand, and the starting pressure timer 21, on the other hand, are replaced by an electrical weigher 26 provided with force sensors 27, 27*a*, 27*b* which support the container 2, as well as a control stage 28. The control stage 28 comprises a regulator 29 which is electrically connected to the force sensors 27, 27*a*, 27*b*, to the switch 30, as well as to a potentiometer 31. The potentiometer 31 applies to the regulator 29 a voltage corresponding to the setting of the flow amplifier relay 17. To this end, the potentiometer wiper 32 is coupled to the output shaft of adjusting motor 20, through the intermediary of a schematically depicted transmission.

The arrangement of FIG. 1 operates as follows:

It is assumed that the series of pouring operations to be performed is such that identical predetermined quantities of molten metal are to be dispensed from container 2 during each one of the pouring operations. The desired pouring pressure $p_g$ is manually set on the pouring pressure regulator 19. The desired pouring time $t_g$ is set on the pouring time timer 22. The starting pressure build-up time $t_v$ and also the rate of change of the starting pressure $\Delta p_v/\Delta t$ are set on the starting pressure timer 21. The venting time $t_e$ is set on the venting timer 15. The values of $p_g$, $t_g$, $t_v$ and $\Delta p_v/\Delta t$ determine the quantity of metal which will be dispensed from the container 2 during one pouring operation, for a given pouring opening 5 and nozzle 6. The venting time $t_e$ is so chosen that the level of the molten metal in the pour-out conduit 4 sinks down only to the predetermined starting level. For a predetermined amount of metal to be poured, the values of $t_g$, $p_g$, $t_v$ and $\Delta p_v/\Delta t$ are interdependent. With repeated dispensing of the same quantity of metal, the selected values of $p_g$, $t_g$, $t_v$ and $\Delta p_v/\Delta t$ can be maintained unchanged. The time $t_v$ is for example selected equal to the time $t_g$.

In addition to this setting of values, and prior to the start of the actual pouring operations, the level of molten metal in the pour-out conduit 4 of the container 2 is raised to the preselected starting level. To this end, first the shut-off valve 10 is opened by hand and then, by means of a single electrical signal, the detector electrode 23 is caused to descend to its operating level and the magnet valve 14 is made to assume a position causing the venting valve 13 to close. Additionally, the just-mentioned signal brings the magnet valve 16 into the conductive position, and furthermore so alters the setting of the flow amplifier relay 17, by activation of the adjusting motor 20, that the signal pressure at the outlet of the relay 17 permits pressure gas to flow into the interior of the container 2, from the source 11 and via the shut-off valve 10 and the flow amplifier 9. With the entry of the pressure gas into the interior of the container 2, the level of the bath in pour-out conduit 4 rises. If the bath level reaches the predetermined starting level, which is located below the level of the pouring opening 5 of the pour-out conduit but above the maximum filling level of the container 2, the upper surface of the molten metal in pour-out conduit 4 contacts the detector electrode 23. The detector electrode 23 responds by applying to the adjusting motor 20 of flow amplifier relay 17 a signal which prevents the gas pressure in the interior of container 2 from rising further, and by applying to the magnet valve 24 a signal causing the valve 24 to assume that position thereof which makes the electrode 23 rise out of the pouring opening 5.

In this way the predetermined starting level of the molten bath in the pour-out conduit 4 is established. The associated value of the starting pressure is $P_{vO}$.

Each individual pouring operation is started by raising the molten metal bath in the pour-out conduit 4 to the level of the pouring opening 5, i.e., to the pouring level. To this end, by means of a second electrical signal, the pouring time timer 22 as well as the starting pressure timer 21 are brought into operation. The pouring time timer 22 brings the magnet valve 18 into the conductive position, and the pouring pressure signal pressure at the outlet of the previously set pouring pressure regulator 19 becomes added, at the output of the flow amplifier relay 17, to the starting pressure signal pressure already present at the output of 17, and is furthermore applied via the magnet valve 16 to the flow amplifier 9. The flow amplifier 9 lets additional gas flow out of the source 11 through the shut-off valve 10 and into the interior of the container 2, in which the gas pressure is increased by the amount of the pouring pressure $p_g$, so that the molten metal can flow out of the nozzle 6 of the pouring opening 5. By means of the triggering of the starting pressure timer 21 which occurs upon the position change of the magnet valve 18, during the time of the pouring, which has as a consequence a lowering of the molten metal level in the interior of container 2 and accordingly an increase of the static pressure of the column of molten metal standing in the pour-out conduit 4, the adjusting motor 20 of the flow amplifier relay 17 is so actuated that the starting pressure $p_v$ in the interior of container 2 increases with time and so that the increase of the static pressure of this fluid column is just balanced out. Since, by way of example, $t_v$ has been selected equal to $t_g$, the starting pressure increases throughout the course of the total pouring time. After elapse of the pouring time, the value of the starting pressure is greater than at the start of the pouring operation by the amount $t_v \cdot (\Delta p/\Delta t) = t_g \cdot (\Delta p/\Delta t)$.

At the end of the pouring time, the pouring time timer 22 brings the magnet valve 18 back to the blocking position. Simultaneously with this switchover of the magnet valve 18, the pouring time timer 22, via its electrical connection with the venting timer 15, triggers the timer 15. The venting timer 15 in turn brings the magnet valve 14 for the venting time $t_e$ into the conductive position, as a result of which the venting valve 13 is open for this time interval. Additionally, at the end of the pouring time, the magnet valve 16, via its electrical connection with the pouring time timer 22, is brought into the blocking position, and after elapse of the venting time interval $t_e$ is brought back into the conductive position. Via the venting valve 13 pressure gas is exhausted into the atmosphere from the interior of container 2, so that the gas pressure exerted upon the surface of the metal bath in the interior of container 2 suddenly decreases. This leads to the termination of the pouring operation. At the end of the venting operation, i.e., after the elapse of the venting time interval $t_e$, the molten metal in the pour-out conduit 4 again finds itself at the predetermined starting level.

After the venting, with the establishment of the starting level in the pour-out conduit 4, and despite gas losses resulting from imperfect sealing of the container 2, in particular in the region of the supporting surface for the cover dome 7, the starting level is maintained by admitting into the interior of container 2 pressure gas at a rate compensating for the gas leakage losses.

The initiation of each successive pouring operation requires only a single electrical signal.

It may happen that different quantities of molten metal are to be dispensed in two successive pouring operations. If so, the values of the pouring pressure $p_g$, the pouring time $t_g$, the starting pressure build-up time $t_v$, and the rate of change of the starting pressure $\Delta p_v/\Delta t$ during one pouring operation, must prior to each pouring operation be set anew in correspondence to the desired quantity of molten metal to be poured during the upcoming pouring operation.

Figure 3:
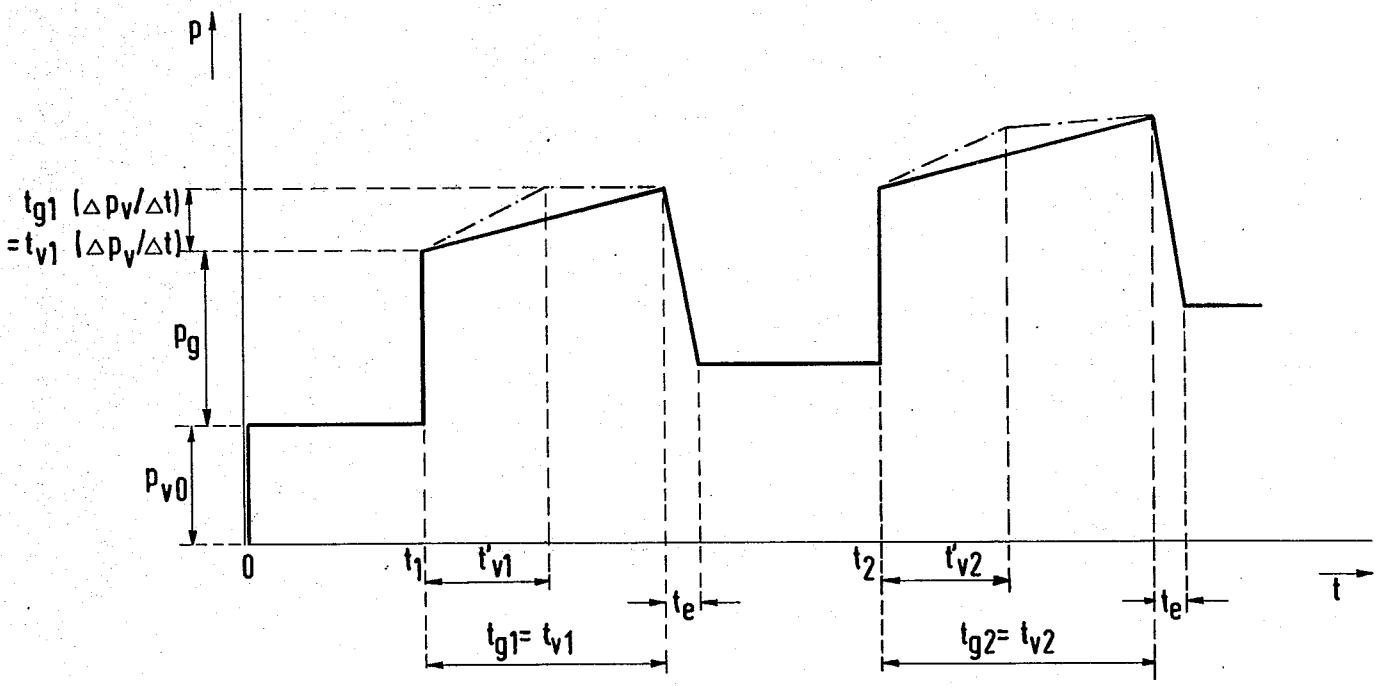
FIG. 3 is a plot of pressure versus time for the pouring arrangement of FIG. 1.

The dependence of the pressure p prevailing in the interior of container 2 upon time $t$ with a pouring set-up as shown in FIG. 1 is depicted in detail in FIG. 3. FIG. 3 depicts the course of events during two successive pouring operations having different pouring times $t_{g1}$ and $t_{g2}$. After initiating operation of the pouring arrangement, the pressure is established, at $t = 0$, at the starting pressure value $p_{vO}$, as a result of which the molten metal in the pour-out conduit 4 rises to the predetermined starting level. At time $t = t_1$ the first pouring operation is started, by superimposing upon the starting pressure $p_{vO}$ the pouring pressure $p_g$. Pouring of molten metal occurs during the pouring time $t_{g1}$. During the entire pouring time $t_{g1}$, the starting pressure continuously increases, specifically with a rate $\Delta p_v/\Delta t$. Upon elapse of the pouring time, the starting pressure $p_v$ has increased, relative to the initial value $p_{v0}$, by the amount $t_{v1} \cdot (\Delta p_v/\Delta t) = t_{g1} \cdot (\Delta p_v/\Delta t)$, since the starting pressure build-up time $t_{v1}$ has been chosen, by way of example, equal to the pouring time $t_{g1}$. After elapse of the pouring time $t_{g1}$ the interior of the container is vented during the venting time interval $t_e$. The pouring operation ends, and a starting pressure having a magnitude $p_v = p_{vO} + t_{v1} \cdot (\Delta p_v/\Delta t)$ is established. The molten metal level in the pour-out conduit 4, at the end of the pouring operation, is again located at the predetermined starting level. At time $t = t_2$ a second pouring operation is started, upon which there is again added to the starting pressure the pouring pressure $p_g$. The pouring time is now $t_{g2} > t_{g1}$.

It may be desired that the starting pressure be made to increase not during the course of the entire pouring time interval, but instead during only a part of the pouring time, for example during the initial time intervals $t_{v1}' < t_{g1}$ or $t_{v2}' < t_{g2}$. If so, then the pressure in the interior of the container 2 would increase during each of the two successive pouring operations in correspondence to the dash-dot lines shown in FIG. 3. On the other hand, in the diagram of FIG. 3, it is assumed for the sake of simplicity that at time $t = 0$, $t_1$ and $t_2$ the pressure changes by an amount equal to $P_{vO}$ or $P_g$ in an infinitesimally short time.

Figure 4:
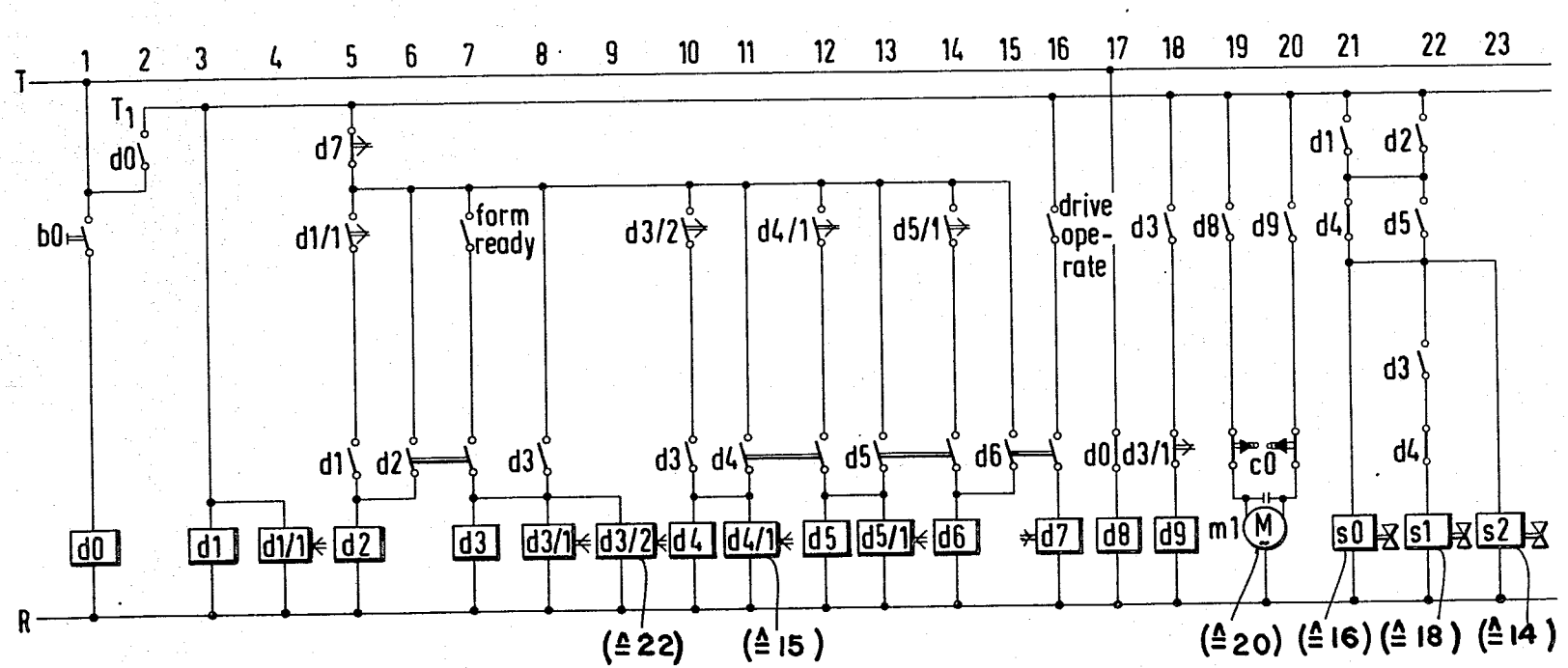
FIG. 4 is a circuit diagram of a control circuit for the arrangement of FIG. 1.

The circuit wiring and the cooperation of the individual electrical elements in a pouring arrangement like that of FIG. 1 is shown in detail in the circuit diagram of FIG. 4. This circuit diagram relates to the case that the amount of metal in the interior of container 2 at the moment at which the pouring arrangement is set into operation is always the same, with the starting pressure in the interior of the container 2 at the start of each first pouring operation in a series of pouring operations always having one end the same value. Additionally, the circuit diagram of FIG. 4 relates to the case in which the starting pressure prior to initiation of operation of the pouring arrangement is greater than the starting pressure $p_{v0}$ to be established at the start of the first pouring operation. This can be the case as a result, for example, of having refilled the container 2 with additional metal prior to the initiation of the first pouring operation. Also, the detector electrode 23 and the associated electrical components are not taken into account.

In FIG. 4 the electrical circuit elements are arranged in different ones of twenty-three current paths, denoted with corresponding numerals. Each current path extends from one to another of three current supply lines T, T1, R. bO designates a switch by means of which the pouring arrangement is set into operation at the start of a series of pouring operations and taken out of operation at the end of such series. Reference characters dO, dl, d1/l, d2, d3, d3/1, d3/2, d4, d4/1, d4, d4/1, d6, d7, d8 and d9 denote relay windings or their associated relay switches. The relays d1/1, d3/1, d3/2, d4/1, d5/1 and d7 are time-delay relays. The time-delay relay d3/1 corresponds to the starting pressure timer 21 of FIG. 1. The time-delay relay d3/2 corresponds to the pouring time timer 22, and the time-delay relay d4/1 corresponds to the venting timer 15 in FIG. 1. sO, s1, s2 denote magnet valves, sO corresponding to magnet valve 16 in FIG. 1, sl corresponding to magnet valve 18 in FIG. 1, and s2 corresponding to the magnet valve 14 associated with the venting valve 13 in FIG. 1. The adjusting motor 20 associated with the flow amplifier relay 17 in FIG. 1 is denoted by ml in FIG. 4. c0 denotes the limit contacts which limit the rotary motion of the output shaft of the adjusting motor ml or 20 in the rotary directions thereof and which, prior to setting the pouring arrangement into operation, are adjusted in correspondence to the amount of metal in the interior of container 2.

The pouring arrangement is set into operation at the start of a series of pouring operations by activating the switch b0 located in current path 1. Simultaneously with the activation of the switch b0, the relay winding d0 likewise located in current path 1 becomes energized, as a result of which the associated normally open switch d0 in current path 2 closes. In this way, the current supply line T1 becomes electrically connected with the current supply line T.

Simultaneously with the establishment of a connection between the current supply lines T and T1, upon setting the pouring arrangement into operation by activating the switch b0 in current path 1, the relay windings d1 and d1/1 in respective current paths 3 and 4 becomes engergized. Energization of relay winding d1 results in closing of the associated normally open switch d1 in current path 21. As a result the magnet valve s0 (16 in FIG. 1) is brought into its conductive position, and the magnet s2 of magnet valve 14 (FIG. 1) is energized, in turn causing the venting valve 13 to close.

The aforementioned energization of the relay winding d0 in current path 1, resulting upon closing of the switch b0 in the same current path 1, results in opening of the associated normally closed switch d0 in current path 17.

This opening of relay switch d0 in current path 17 results in energization of the relay winding d8, also located in current path 17. Energization of relay winding d8 results in closing of relay switch d8 in current path 19, which in turn sets into motion the adjusting motor ml (20 in FIG. 1). The adjusting motor ml (20 in FIG. 1) adjusts the setting of the flow amplifier relay 17 to an extent corresponding to the setting of the limit contacts c0, until the starting pressure in the interior of container 2 is reduced to the predetermined value $p_{v0}$.

A further consequence of the closing of switch b0 and the resulting energization of relay winding d1 in current path 3 is the closing of associated relay switch d1 in current path 5. Closing of switch b0 also results in energization of time-delay relay winding d1/1 in current path 4, and after elapse of the time delay associated with this relay the relay switch d1/1 in current path 5 closes. This time delay is selected to be so long that the predetermined starting pressure can be reached and accordingly the molten metal level in the pour-out conduit 4 can reach the predetermined starting level.

The level of the molten metal in the pour-out conduit 4 is now at the predetermined starting level, and the first pouring operation can be started.

When the normally open relay switch d1/1 in current path 5 closes, relay winding d2 also located in this current path becomes energized. Energization of relay winding d2 results in closing of the associated switches d2 in current paths 6 and 7. As soon as a casting form has been placed precisely in position under the nozzle 6 of the pouring opening 5, the switch denoted "form ready" in current path 7 is activated, manually or otherwise, resulting in initiation of the individual pouring operation.

Closing of the form ready switch in current path 7 results in energization of the auxiliary relay winding d3, and accordingly results in energization of the time-delay relay windings d3/1 and d3/2, respectively corresponding to the starting pressure timer 21 and the pouring time timer 22 of FIG. 1, these timers thus being set into operation. The relay winding d3 is maintained energized by the self-locking action effected by its associated relay switch d3 in current path 8.

Energization of relay winding d3 in current path 7, resulting upon activation of the form ready switch in the same current path, also results in closing of the associated relay switch d3 in current path 22. This in turn results in energization of the winding sl of magnet valve 18 (see FIG. 1) also located in current path 22, causing the magnet valve 18 to be brought into the conductive position. Likewise, the relay switch d3 in current path 18 closes, resulting in energization of relay winding d9 and in closing of the associated relay switch d9 located in current path 20. Closing of relay switch d9 in current path 20 results in energization of the adjusting motor ml (20 in FIG. 1), so that the starting pressure in the interior of the container rises with time, and specifically in such a manner that the rise of the static pressure of the column of molten metal standing in the pour-out conduit 4 is just balanced out by the rise in the starting pressure.

After elapse of the starting pressure build-up time $t_v$ set on the time-delay relay d3/1, which may for example have the same magnitude as the pouring time $t_g$, the normally closed relay switch d3/1 in current path 18 opens, as a result of which the relay winding d9 likewise located in current path 18 and energized at the start of the pouring now becomes deenergized again. The deenergization of the relay winding d9 causes the associated relay switch d9, located in current path 20, and closed at the start of the pouring, to open again, as a result of which the adjusting motor ml (20 in FIG. 1) is taken out of operation. In this way the starting pressure buildup during the pouring operation ends.

The closing of the form ready switch in current path 7 as well as the resulting energization of the relay winding d3 in current path 7 results in closing of the associated relay switch d3 in current path 10. The normally open relay switch d3/2, likewise located in current path 10, and associated with the relay winding d3/2 in current path 9, this relay winding d3/2 becoming energized in response to closing of the form ready switch, and being associated with the pouring time timer 22, closes only after elapse of the pouring time $t_g$ which the time-delay d3/2 is set. Closing of the normally open relay switch d3/2 of the time-delay relay d3/2, after elapse of the pouring time $t_g$, results in energization of the relay windings d4 and d4/1, respectively located in the current paths 10 and 11.

Energization of the relay winding d4, after elapse of the pouring time $t_g$, results in opening of the associated normally closed relay switches d4 located in the current paths 21 and 22. This opening results in activation of the magnet valves s0, s1 and s2. The magnet valve 16, connected to the outlet of the flow amplifier relay 17 and having a winding s0, and the magnet valve 18 having a winding s1 are both brought into the blocking position, as a result of which the supply of pressurized air into the container 2 is interrupted. Additionally, activation of the magnet valve 14 (having winding s2 in FIG. 4) results in opening of the associated venting valve 13. After the simultaneous activation of these three magnet valves, pressure gas can escape from the interior of container 2, so that the pouring operation is ended.

The closing of the normally open relay switch d3/2 in the current path 10, after elapse of the pouring time following energization of the associated relay winding d3/2, results in energization of the time-delay relay winding d4/1 which is located in current path 11 and associated with the venting timer 15. The venting time interval $t_e$ is set on the time-delay relay d4/1 of the venting timer 15.

Energization of the relay winding d4 in the current path 10 results in closing of the associated holding switches d4 in the current paths 11 and 12. By means of these holding switches the relay windings d4 and d4/1 are maintained energized.

After elapse of the venting time interval $t_e$, the normally open relay switch d4/1 in current path 12 closes. As a result, the relay windings d5 and d5/1 in the current paths 12 and 13 become energized. Energization of the relay winding d5 results in closing of the associated normally open relay switch d5 in current path 22, as a result of which the winding s0 of magnet valve 16 becomes energized again, bringing the magnet valve into the conductive position, whereas simultaneously therewith the winding s2 of magnet valve 14 is energized bringing this magnet valve into the blocking position. The transition of magnet valve 14 to blocking position causes venting valve 13 to close again. This ends the venting operation, and the molten metal in the pour-out conduit 4 again finds itself at the predetermined starting level.

After elapse of the venting time interval $t_e$ set upon the time-delay relay d4/1, energization of the relay winding d5 located in the current path 12 causes the associated normally open relay switches d5 in the current paths 13 and 14 to close.

The time-delay relay d5/1 is set for a certain delay time. After elapse of this time interval, the relay switch d5/1 located in the current path 14 closes, resulting in energization of the relay winding d6. Energization of relay winding d6 results in closing of the associated normally open relay switches d6 in the current paths 15 and 16. In this way, the casting form now filled with metal can be transported away by means of a conveyor and a new casting form can be brought into position under tbe nozzle 6 of the pouring opening 5 and made ready to receive molten metal.

Along with the setting into operation of the drive for the transport conveyor for the casting forms, the normally open "drive operate" switch in the current path 16 is closed. This results in energization of the time-delay relay winding d7, also located in the current path 16. During the time interval set on the time-delay relay d7, the normally closed switch d7 in the current path 5 is open, and accordingly the relay windings d2, d3, d3/1, d3/2, d4, d4/1, d5, d5/1, d6 and d7 are all not energized.

A new pouring operation starts as soon as the "form ready" switch in the current path 7 is activated.

If, with a pouring arrangement such as shown in FIG. 1, the interior of the container 2, during the course of a series of pouring operations, whether during the course of a single pouring operation, or whether during the interval between two successive pouring operations, is to be replenished with additional molten metal, then the starting pressure during the time of the replenishment will be decreased by means of the adjusting motor 20 by an amount corresponding to the quantity of molten metal added during such replenishment.

With the pouring arrangement of FIG. 2, the establishment of the starting level is performed prior to each pouring operation, and the maintenance of the starting level and the build-up with time of the starting pressure $p_v$ in the interior of container 2 during each individual pouring operation are performed by means of the electric weigher 26 and the associated control stage 28.

To this end, both the desired and actual values for the starting pressure are continually determined. The desired value for the starting pressure is determined in that the respective weighed value of the quantity of metal in the container 2 is determined by the weigher 26, this value corresponding to the starting pressure desired value needed at the time of the weighing, i.e., corresponding to that value which will cause the metal bath in the pour-out conduit 4 of the container 2 to rise to the starting level. An electrical voltage proportional to the respective weighed value is applied to the regulator 29 of the control stage 28. The actual value of the starting pressure is ascertained by means of the setting of the flow amplifier relay 17 which in turn is operative for establishing the actual value of the starting pressure. To this end, the output shaft of adjusting motor 20, already coupled to the adjusting element of flow amplifier relay 17, is additionally mechanically coupled to the wiper 32 of the potentiometer 31. At a certain setting of the flow amplifier relay 17, and accordingly with a certain actual value of the starting pressure in the interior of container 2, the wiper 32 assumes a certain setting. The regulator 29 of the control stage 28 receives from the potentiometer an electrical voltage corresponding to the setting of the flow amplifier relay 17, so that there is applied to the regulator 29 an electrical voltage proportional to the actual value of the starting pressure in container 2. Changes in the setting of the flow amplifier relay 17 and accordingly of the actual value of the starting pressure in the interior of container 2 cause a change of position of the wiper 32 of the potentiometer 31, so that the electrical voltage applied to the regulator 29 by the potentiometer 31 likewise changes. The two voltages applied to the regulator 29, on the one hand from the electrical weigher 26, and on the other hand from the potentiometer 31, are compared against each other within the regulator 29. In the event of a discrepancy between the actual value of the starting pressure and the value desired therefor, the adjusting motor 20 is activated by means of the switch 30, as a result of which setting of the flow amplifier relay 17, depending upon the sign and magnitude of the discrepancy detected within regulator 29, is changed either in direction towards the blocking position or in direction towards the unblocking position. In this way, it is ensured that upon setting the pouring arrangement into operation the starting pressure needed for raising the molten metal in the pour-out conduit 4 to the predetermined starting level is continually maintained, and specifically during the time intervals between successive pouring operations, during each individual pouring operation, and also during replenishment of the container 2.

With the pouring arrangement of FIG. 2, to effect the dispensing of a predetermined quantity of metal during the pouring operation, prior to the pouring operation the corresponding values of the pouring pressure Pg, the pouring time $t_g$, and the venting time interval $t_e$ are respectively set on the pouring pressure regulator 19, on the pouring time timer 22, and on the venting timer 15. The starting pressure build-up time $t_v$ is, for the purposes of this explanation, always equal to the pouring time $t_g$.

Thereafter, the raising of the molten bath in the pour-out conduit 4 of the container 2 up to the starting level is effected with the magnet valve 18 in the blocked position and the magnet valve 16 in the conductive position. The regulator 29 of the control stage 28 receives from the weigher 26 an electrical voltage proportional to the detected weight of the quantity of metal in the container 2, whereas the regulator 29 simultaneously receives from the potentiometer 31 a second electrical voltage proportional to the setting of the flow amplifier relay 17. The regulator 29, by means of the switch 30 and the adjusting motor 20, continues to change the setting of the flow amplifier relay 17 until the starting pressure requisite for the detected weight has built up.

After this establishment of the starting level in the pour-out conduit 4, the actual pouring operation is initiated, as was the case with the pouring arrangement of FIG. 1, first raising the molten metal in the pour-out conduit 4 up to the pouring level, resulting in the triggering of the pouring time timer 22 by an electrical signal. The pouring time timer 22, after being triggered, brings the magnet valve 18 into the conductive position, so that the pouring pressure signal pressure established at the outlet of the pouring pressure regulator 19 becomes added to the starting pressure signal pressure already established at the outlet of the flow amplifier relay 17. As a result, additional pressure gas flows out of the pressure gas source 11 through the flow amplifier 9 and into the interior of container 2, causing the starting pressure $P_{v0}$ prevailing in the interior of container 2 to be increased by the amount of the pouring pressure $p_g$, whereupon the pouring of molten metal out of the nozzle 6 of the pouring opening 5 begins.

During the pouring, the increase of the static pressure of the molten metal column standing in the pour-out conduit 4 between the pouring opening and the level of the molten metal in the interior of the container, resulting from the descent of the level of the molten metal in the interior of the container, is balanced out by an increase in the starting pressure signal pressure at the outlet of the flow amplifier relay 17, resulting from activation of the adjusting motor 20. To this end, the weighed value detected by the weigher 26, on the one hand, and the setting of the flow amplifier relay 17, on the other hand, are continuously converted during the pouring operation into electrical voltages. These voltages are compared against each other, within the regulator 29 of the control stage 28, and, in the event that the comparison results in the detection of a discrepancy between the desired and actual values of starting pressure, the adjusting motor 20 is activated by means of the switch 30 to effect an adjustment of the setting of the flow amplifier relay 17. Accordingly, with decreasing weight of metal, additional pressure gas flows continuously into the interior of the container 2.

After elapse of the pouring time, the pouring time timer 22, as with the arrangement of FIG. 1, brings the magnet valve 18 into the blocking position. The pouring time timer 22, as it effects the change of position of valve 18, generates an electrical signal which it applies, on the one hand, to the venting timer 15 which in turn effects the opening of the venting valve 13 by means of the associated magnet valve 14 and, on the other hand, to the winding of the magnet valve 16 which is brought into the blocking position. Upon opening of the venting valve 13, the upper surface of the metal bath in the pour-out conduit 4 sinks down, and the pouring operation ends.

After elapse of the venting time interval $t_e$, the venting valve 13 is brought into the blocking position, and the magnet valve 16 is brought into the conductive position.

With the pouring arrangement of FIG. 2, as with that of FIG. 1, the starting level established by venting after each pouring operation is maintained despite gas leakages, by introducing additional pressure gas into the interior of the container 2 in an amount corresponding to the leakages until the start of the next-following pouring operation.

The dependence upon time of the pressure gas exerting a pressing force upon the molten metal in the interior of the container 2 corresponds basically to the diagram shown in FIG. 3 and discussed with reference to the pouring arrangement of FIG. 1.

Figure 5:
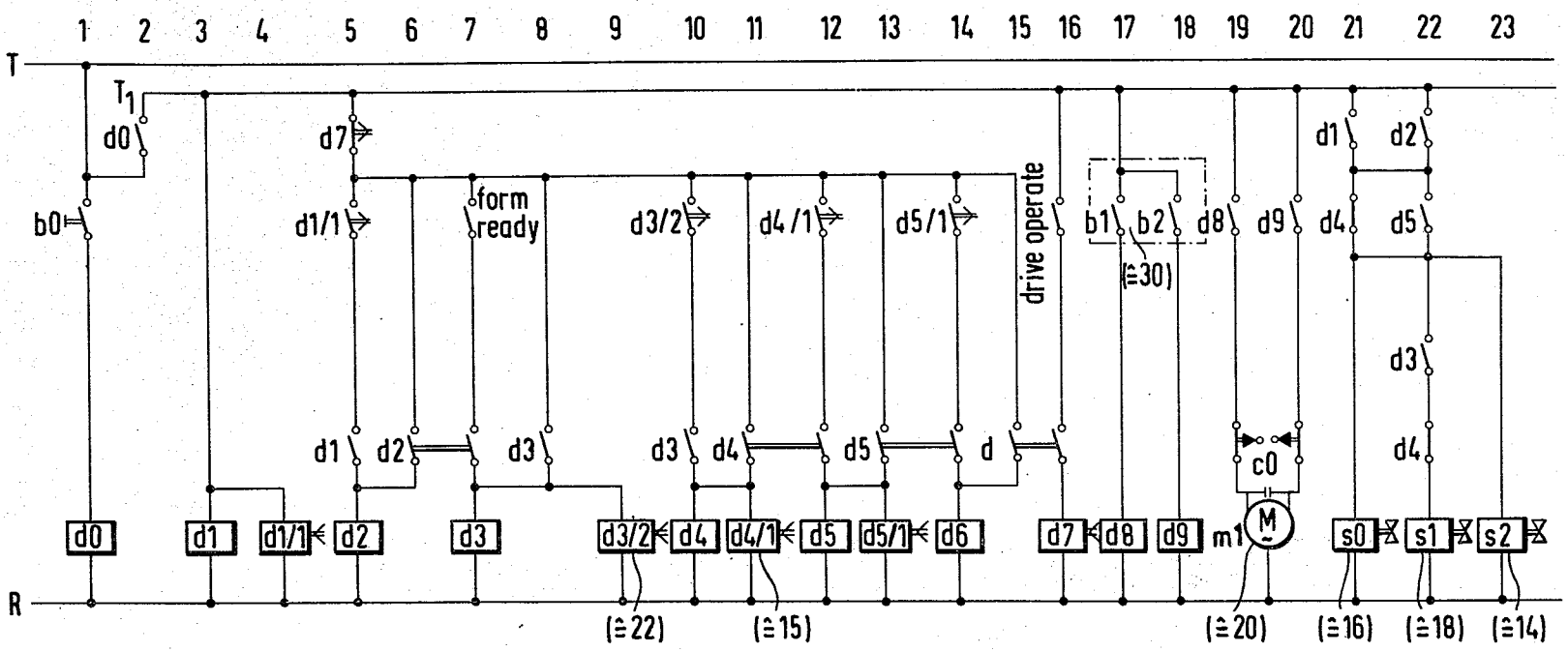
FIG. 5 is a circuit diagram of a control circuit for the arrangement of FIG. 2.

The circuit diagram of FIG. 5 shows in detail the electrical wiring and the cooperation of the different electrical elements in the case of a pouring arrangement like that of FIG. 2. This circuit diagram does not necessarily relate to the case where the quantity of metal in the interior of container 2 is always the same at the moment the pouring arrangement is set into operation and where additionally the starting pressure prior to setting the arrangement into operation is greater than the pressure $P_{v0}$ which is to be established prior to the start of the first pouring operation.

The circuit diagram of FIG. 5 differs from that of FIG. 4 only with respect to the current paths 8, 17 and 18. In the current path 8 of FIG. 5 there is not present the timedelay relay winding d3/1 of current path 8 of FIG. 4, which there is associated with the starting pressure timer 21 of FIG. 1; a starting pressure timer of this type is not needed with a pouring arrangement like that shown in FIG. 2. Additionally, in the current path 17 of FIG. 5 there is not present the normally closed relay switch d0 of FIG. 4, and in the current path 18 of FIG. 5 there are not present the normally open relay switch d3 and the normally closed relay switch d3/1. Instead, in the current paths 17 and 18 of FIG. 5, besides the relay windings d8 and d9, there are located respective normally open switches b1 and b2 corresponding to the switch designated with numeral 30 in FIG. 2.

After turning on the pouring arrangement by activating the switch b0, as a result of which the current supply lines T and T1 become connected via the relay winding d0 and associated relay switch d0, the actual and desired values of the starting pressure prevailing in the interior of container 2 are continuously determined, and each converted into a respective proportional electrical voltage. If there arises a discrepancy between these values, or the voltages representing these values, such discrepancy gives rise to the closing of either the switch b1 in current path 17 or the switch b2 in current path 18. Thereafter, in the event of such a discrepancy, either the relay winding d8 in current path 17 becomes energized resulting in closing of the associated normally open relay switch d8 in current path 19, or else the relay winding d9 in current path 18 becomes energized resulting in closing of the associated normally open relay switch d9 in current path 20. In this way, in the event of a discrepancy between the desired and actual values of the starting pressure, the adjusting motor ml (20 in FIG. 2) is caused to turn in either one or the other direction, and the actual value of the starting pressure prevailing in the interior of container 2 either decreases or increases, depending upon whether a decrease or an increase is necessary to decrease the detected discrepancy.

If with the pouring arrangement of FIG. 2 different amounts of metal are to be poured off during each individual pouring operation, then the values of the pouring pressure and of the pouring time must for each pouring operation be set anew on the pouring pressure regulator 19 and on the pouring time timer 22, respectively, in correspondence to the desired quantities to be poured.

If the container is replenished with molten metal during a pouring operation or between two pouring operations, then the starting pressure in the interior of container 2 is decreased by means of the weigher 26 and the control stage 28 in correspondence to the weight increase of the melt 1.

It will be understood that each of the elements described above, or two or more together, may also find a useful application in other types of circuits and constructions differing from the types described above.

While the invention has been illustrated and described as embodied in two different exemplary embodiments of a pouring arrangement embodying concepts of the invention, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of pouring, in at least two successive pouring operations, predetermined amounts of molten metal from a container having an interior closed off substantially gas-tightly and provided with a pourout conduit which has an inlet communicating with the interior of the container and which has an outlet pouring opening located outside the container above the highest level to which molten metal in the container interior is permitted to rise during the method, comprising the steps of selecting pouring pressure values utilizing a pouring pressure selector; selecting starting pressure increase functions utilizing a starting pressure selector; establishing the metal in said conduit at a fixed starting level prior to the start of the first pouring operation by feeding pressurized gas into the space above the molten metal in the container interior; and thereafter effecting each pouring operation by activating the pouring pressure selector to effect a first boost of the gas pressure in said space by the amount of a selected pouring pressure value so as to effect pouring out through said opening of the quantity of molten metal to be dispensed, during each such pouring operation activating the starting pressure selector to cause the latter to superimpose upon the first pressure boost a second pressure boost equal to a selected starting pressure increase function, and at the end of each pouring operation activating means operative for decreasing the gas pressure in said space by the amount of the selected pouring pressure value so as to cause the metal in said conduit to return to the fixed starting level in readiness for the next pouring operation, the pressure prevailing in said space at the end of such gas pressure decrease constituting the new starting pressure, and maintaining such new starting pressure until the start of the next following pouring operation.

2. A method as defined in claim 1, wherein said starting pressure increase is effected during the entire course of the pouring operation.

3. A method as defined in claim 1, wherein said starting pressure increase is effected during only a portion of the course of the pouring operation.

4. A method as defined in claim 1, wherein at least one of said second pressure boost and said gas pressure decrease and said maintaining of the new starting pressure is performed automatically.

5. A method as defined in claim 1, wherein at least one of said second pressure boost and said maintaining of the new starting pressure is effected by introducing additional pressurized gas into the container interior.

6. A method as defined in claim 5, wherein said introducing of additional pressurized gas is effected in a stepwise manner.

7. A method as defined in claim 5, wherein said introducing of additional pressurized gas is effected in a continuous manner.

8. A method as defined in claim 5, wherein said introducing of additional pressurized gas is effected by effecting a stepwise change in the setting of a gas supply valve.

9. A method as defined in claim 5, wherein said introducing of additional pressurized gas is effected by effecting a continuous change in the setting of a gas supply valve.

10. A method as defined in claim 5, wherein said introducing of additional pressurized gas is effected by means of a starting pressure timer operative for controlling the duration of the time interval during which additional pressurized gas is introduced into the container interior for the purpose of effecting the second pressure boost.

11. A method as defined in claim 5, wherein said introducing of additional pressurized gas is effected in automatic dependence upon the detection by a weigher of the weight of the quantity of molten metal in the container interior.

12. A method as defined in claim 5, wherein said introducing of additional pressurized gas comprises introducing said additional gas into the container interior through a controllable gas supply valve, and further comprises using a weigher to generate an electrical signal indicative of the weight of the quantity of metal in the container interior and applying such electrical signal to means operative for changing the setting of the controllable gas supply valve.

13. A method as defined in claim 1, wherein said decreasing of the gas pressure in the space above the molten metal in the container interior is effected by briefly opening a venting valve communicating with said space.

14. A method as defined in claim 13, wherein said opening of a venting valve comprises using a pouring time timer to apply a valve-opening signal to the venting valve after elapse of the respective pouring time.

15. A method as defined in claim 13, wherein said decreasing of the gas pressure in the space above the molten metal in the container interior further comprises closing said venting valve after the elapse of a time interval corresponding to the weight of the quantity of molten metal located in the container interior and detected by a weigher.

16. A method as defined in claim 1, wherein both said second pressure boost and said maintaining of the new starting pressure are effected by introducing additional pressurized gas into the container interior.

17. A method as defined in claim 1, wherein the selecting of starting pressure increase functions utilizing a starting pressure selector comprises adjusting means operative for determining the duration of such second gas pressure boost.

18. A pouring arrangement operative for pouring predetermined amounts of molten metal in at least two successive pouring operations, comprising, in combination, a container having an interior closed off substantially gas-tightly and provided with a pour-out conduit which has an inlet communicating with the interior of the container and which has an outlet pouring opening located outside the container above the highest level to which molten metal in the container interior is permitted to rise; pouring pressure selector means for selecting pouring pressure value; starting pressure selector means for selecting starting pressure increase functions; means for establishing the metal in said conduit at a predetermined starting level prior to the start of the first pouring operation by feeding pressurized gas into the space above the molten metal in the container interior; means for thereafter effecting each pouring operation by effecting a first boost of the gas pressure in said space by the amount of a pouring pressure value selected on said pouring pressure selector means to effect pouring out through said pouring opening of the quantity of molten metal to be dispensed; means operative for superimposing upon the first pressure boost a second pressure boost equal to a starting pressure increase function selected on said starting pressure selector means; and means operative at the end of each pouring operation for decreasing the gas pressure in said space by the amount of the selected pouring pressure value to cause the metal in said conduit to sink down to said starting level and operative for maintaining said pressure at that value to maintain the metal at said starting level until the start of the next-following pouring operation, the pressure prevailing in said space at the end of such gas pressure decrease constituting the new starting pressure.

19. An arrangement as defined in claim 18, wherein said means for decreasing the gas pressure in said space comprises a venting valve, and a venting timer connected to said venting valve and operative for causing said venting valve to open for a predetermined time interval, wherein said means for effecting the first gas pressure boost space comprises a controllable gas supply valve, a pouring time timer connected to said supply valve and operative for determining the duration of the first pressure boost and operative at the end of the pouring operation for initiating operation of said venting timer, and an adjustable starting pressure timer connected to said supply valve and operative for effecting the second pressure boost in said space during at least a portion of a pouring time interval.

20. An arrangement as defined in claim 18, wherein said means for effecting the first gas pressure boost in said space comprises a controllable gas supply valve, a pouring time timer connected to said supply valve and operative for determining the duration of the first pressure boost, weighing means operative for generating an electrical signal indicative of the weight of the molten metal in the container interior, and a control stage operative for receiving the electrical signal and controlling the setting of said gas supply valve in dependence thereon.

21. An arrangement as defined in claim 20, wherein said weighing means comprises a weigher operative for measuring the weight of the molten metal in the container interior and a measuring transducer connected to said weigher and operative for converting the indication provided by the weigher into a proportional electrical signal and applying such signal to said control stage.

22. An arrangement as defined in claim 18, wherein the starting pressure selector means comprises means operative for determining the duration of such second gas pressure boost.

23. An arrangement as defined in claim 18, wherein the starting pressure selector means comprises means for weighing the amount of molten metal in the interior of the container and as a function of the decrease in the sensed weight automatically effecting the second pressure boost.

24. A method of pouring, in at least two successive pouring operations, predetermined amounts of molten metal from a container having an interior closed off substantially gas-tightly and provided with a pour-out conduit which has an inlet communicating with the interior of the container and which has an outlet pouring opening located outside the container above the highest level to which molten metal in the container interior is permitted to rise during the method, comprising the steps of establishing the metal in said conduit at a predetermined starting level prior to the start of the first pouring operation by feeding pressurized gas into the space above the molten metal in the container interior; thereafter effecting each pouring operation by boosting the gas pressure in said space by an amount requisite to effect pouring out through said pouring opening of the quantity of molten metal to be dispensed; and at the end of each pouring operation, decreasing the gas pressure in said space to a value causing the metal in said conduit to sink down to said starting level, and maintaining said pressure at that value to maintain the metal at said starting level until the start of the next-following pouring operation, wherein said step of establishing the metal in said conduit at said starting level comprises feeding pressurized gas into said space to establish in such space a starting pressure having the value needed to maintain the molten metal in the pour-out conduit at such starting level, said starting level being a fixed level located above said highest level but below said pouring opening, wherein said step of effecting each pouring operation by boosting the gas pressure comprises initiating each pouring operation by boosting the gas pressure in said space from the starting pressure requisite for maintaining the metal at said starting level by the amount of a predetermined pouring pressure resulting in the establishment in said space of a total feed pressure causing molten metal to be poured out of said conduit through said pouring opening, and balancing out the increase of the static pressure difference in the pour-out conduit between the pouring opening and the level of the melt in the container interior resulting from pouring by effecting a starting pressure increase corresponding to the dispensed quantity of metal, and wherein said step of decreasing the gas pressure in said space comprises, at the end of each pouring operation, depressurizing the space above the molten metal in the container interior for so long a time until the metal level in the pour-out conduit has sunk back down to the fixed starting level, with the pressure prevailing in said space at the end of such depressurizing constituting the new starting pressure, and maintaining such new starting pressure until the start of the next-following pouring operation, wherein at least one of said starting pressure increase and said maintaining of the new starting pressure is effected by introducing additional pressurized gas into the container interior, wherein said introducing of additional pressurized gas comprises introducing said additional gas into the container interior through a controllable gas supply valve, and further comprises using a weigher to generate an electrical signal indicative of the weight of the quantity of metal in the container interior, applying such electrical signal to means for generating a corresponding signal indicative of the required starting pressure in the container interior, generating an electrical signal indicative of the actual starting pressure in the container interior, applying the last two signals to a comparator operative for generating a discrepancy-indicating signal, and applying the discrepancy-indicating signal to means operative for changing the setting of the controllable gas supply valve.

25. A method of pouring, in at least two successive pouring operations, predetermined amounts of molten metal from a container having an interior closed off substantially gas-tightly and provided with a pour-out conduit which has an inlet communicating with the interior of the container and which has an outlet pouring opening located outside the container above the highest level to which molten metal in the container interior is permitted to rise during the method, comprising the steps of establishing the metal in said conduit at a predetermined starting level prior to the start of the first pouring operation by feeding pressurized gas into the space above the molten metal in the container interior; thereafter effecting each pouring operation by boosting the gas pressure in said space by an amount requisite to effect pouring out through said pouring opening of the quantity of molten metal to be dispensed; and at the end of each pouring operation, decreasing the gas pressure in said space to a value causing the metal in said conduit to sink down to said starting level, and maintaining said pressure at that value to maintain the metal at said starting level until the start of the next-following pouring operation, wherein said step of establishing the metal in said conduit at said starting level comprises feeding pressurized gas into said space to establish in such space a starting pressure having the value needed to maintain the molten metal in the pour-out conduit at such starting level, said starting level being a fixed level located above said highest level but below said pouring opening, wherein said step of effecting each pouring operation by boosting the gas pressure comprises initiating each pouring operation by boosting the gas pressure in said space from the starting pressure requisite for maintaining the metal at said starting level by the amount of a predetermined pouring pressure resulting in the establishment in said space of a total feed pressure causing molten metal to be poured out of said conduit through said pouring opening, and balancing out the increase of the static pressure difference in the pour-out conduit between the pouring opening and the level of the melt in the container interior resulting from pouring by effecting a starting pressure increase corresponding to the dispensed quantity of metal, and wherein said step of decreasing the gas pressure in said space comprises, at the end of each pouring operation, depressurizing the space above the molten metal in the container interior for so long a time until the metal level in the pour-out conduit has sunk back down to the fixed starting level, with the pressure prevailing in said space at the end of such depressurizing constituting the new starting pressure, and maintaining such new starting pressure until the start of the next-following pouring operation, wherein said depressurizing of the space above the molten metal in the container interior is effected by briefly opening a venting valve communicating with said space, wherein said depressurizing of the space above the molten metal in the container interior further comprises using a venting timer on which is set a venting time interval for effecting closing of said venting valve automatically after elapse of a venting time interval corresponding to the quantity of metal dispensed during the preceding pouring operation.

26. A pouring arrangement operative for pouring predetermined amounts of molten metal in at least two successive pouring operations, comprising, in combination, a container having an interior closed off substantially gas-tightly and provided with a pour-out conduit which has an inlet communicating with the interior of the container and which has an outlet pouring opening located outside the container above the highest level to which molten metal in the container interior is permitted to rise; means for establishing the metal in said conduit at a predetermined starting level prior to the start of the first pouring operation by feeding pressurized gas into the space above the molten metal in the container interior; means for thereafter effecting each pouring operation by boosting the gas pressure in said space by an amount requisite to effect pouring out through said pouring opening of the quantity of molten metal to be dispensed; and means operative at the end of each pouring operation for decreasing the gas pressure in said space to a value causing the metal in said conduit to sink down to said starting level and operative for maintaining said pressure at that value to maintain the metal at said starting level until the start of the next-following pouring operation, wherein said means for effecting each pouring operation by boosting the gas pressure in said space comprises a controllable gas supply valve, a pouring time timer connected to said supply valve and operative for determining the duration of the pressure boost, weighing means operative for generating an electrical signal indicative of the weight of the molten metal in the container interior, and a control state operative for receiving the electrical signal and controlling the setting of said gas supply valve in dependence thereon, wherein said means for decreasing the gas pressure in said space comprises a venting valve and a venting timer connected to said venting valve and operative for causing said venting valve to open for a predetermined time interval, and wherein said pouring time timer is operative at the end of each pouring operation for initiating operation of said venting timer, and wherein said control state is electropneumatically connected to said venting valve through the intermediary of said venting timer.

27. A pouring arrangement operative for pouring predetermined amounts of molten metal in at least two successive pouring operations, comprising, in combination, a container having an interior closed off substantially gas-tightly and provided with a pour-out conduit which has an inlet communicating with the interior of the container and which has an outlet pouring opening located outside the container above the highest level to which molten metal in the container interior is permitted to rise; means for establishing the metal in said conduit at a predetermined starting level prior to the start of the first pouring operation by feeding pressurized gas into the space above the molten metal in the container interior; means for thereafter effecting each pouring operation by boosting the gas pressure in said space by an amount requisite to effect pouring out through said pouring opening of the quantity of molten metal to be dispensed; and means operative at the end of each pouring operation for decreasing the gas pressure in said space to a value causing the metal in said conduit to sink down to said starting level and operative for maintaining said pressure at that value to maintain the metal at said starting level until the start of the next-following pouring operation, wherein said means for effecting each pouring operation by boosting the gas pressure in said space comprises a controllable gas supply valve, a pouring time timer connected to said supply valve and operative for determining the duration of the pressure boost, weighing means operative for generating an electrical signal indicative of the weight of the molten metal in the container interior, and a control stage operative for receiving the electrical signal and controlling the setting of said gas supply valve in dependence thereon, wherein said weighing means comprises a weigher operative for measuring the weight of the molten metal in the container interior and a measuring transducer connected to said weigher and operative for converting the indication provided by the weigher into a proportional electrical signal and applying such signal to said control state, wherein said control stage includes a regulator operative for receiving the electrical signal indicative of the weight of the molten metal in the container interior, said signal being indirectly indicative of the desired value for the starting pressure, and being operative for also receiving a signal indicative of the actual starting pressure in said space, and being operative for generating a discrepancy-indicating signal, and means for controlling the setting of said gas supply valve in dependence upon said discrepancy-indicating signal.--

28. An arrangement as defined in claim 27, wherein said control stage further includes a potentiometer having a wiper electrically connected to said regulator for furnishing to the latter said signal indicative of the actual starting pressure in said space, and wherein said means for controlling the setting of said gas supply valve includes an adjusting motor, a control valve whose setting is adjusted by said adjusting motor, and means for applying said discrepancy-indicating signal to said adjusting motor for controlling the latter, the output shaft of said adjusting motor and said wiper being mechanically coupled together.

* * * * *